US007469485B1

(12) United States Patent
Perdue

(10) Patent No.: US 7,469,485 B1
(45) Date of Patent: Dec. 30, 2008

(54) APPARATUS FOR REPLICATING QUADRILATERAL SHAPES

(76) Inventor: Joab Jay Perdue, 721 W. Front St., Erin, TN (US) 37061

( * ) Notice: Subject to any disclaimer, the term of this patent is extended or adjusted under 35 U.S.C. 154(b) by 0 days.

(21) Appl. No.: 11/801,184

(22) Filed: May 10, 2007

(51) Int. Cl.
*B43L 7/12* (2006.01)

(52) U.S. Cl. ..... 33/562; 33/454; 33/464

(58) Field of Classification Search ..... 33/454, 33/456, 460, 464, 465, 470, 472, 473, 562, 33/563, 565
See application file for complete search history.

(56) References Cited

U.S. PATENT DOCUMENTS 785,756 A * 3/1905 Nutz ..... 33/454
1,442,136 A * 1/1923 Eads ..... 33/456
1,559,386 A * 10/1925 Valentine ..... 33/452
2,821,027 A * 1/1958 Billhimer, Sr. ..... 33/456
3,910,327 A * 10/1975 Heckenlaible ..... 144/136.1
3,985,168 A 10/1976 Lundquist
4,062,123 A 12/1977 Lundquist
4,195,681 A 4/1980 Douglas et al.
4,770,216 A * 9/1988 Ruscak ..... 33/562
4,827,625 A * 5/1989 Le Moal ..... 33/562
5,076,162 A 12/1991 Goin
5,161,789 A 11/1992 Rogers
RE34,374 E 9/1993 Davidson
5,927,668 A 7/1999 Cyrell
6,195,903 B1 * 3/2001 Inglehart ..... 33/454
6,553,683 B1 * 4/2003 Klass et al. ..... 33/562
6,810,598 B2 11/2004 Boys
6,986,210 B1 * 1/2006 Conway ..... 33/562

* cited by examiner

*Primary Examiner*—G. Bradley Bennett
(74) *Attorney, Agent, or Firm*—Norman B. Rainer

(57) ABSTRACT

Apparatus having four pivotably interconnected sides of slidably adjustable length is provided for conforming to the size and configuration of quadrilateral shapes to permit replication of the shapes upon a flat surface or within an aperture. Threaded bolts equipped with wing nuts permit adjustments in the lengths and angular relationships of the sides.

8 Claims, 3 Drawing Sheets

APPARATUS FOR REPLICATING QUADRILATERAL SHAPES

BACKGROUND OF THE INVENTION

1. Field of the Invention

This invention concerns a hand tool which can be caused to adjustably conform to the size and configuration of quadrilateral shapes to permit replication of said shapes upon a flat surface or within an aperture.

2. Description of the Prior Art

In the building trades and other applications there are instances where the exact size and configuration of the outer perimeter of a four-sided shape must be replicated. A typical example is in the cutting of an aperture in a wall to closely accommodate a through-going air-handling duct whose cross-sectional perimeter is defined by four straight sides in a substantially rectangular configuration. In another example, it is sometimes necessary to construct a conduit or other structure intended to pass through an existing, substantially rectangular aperture in a wall. The following U.S. patents disclose devices for measuring or adjustably accommodating structures of substantially rectangular shape.

U.S. Pat. No. 5,927,668 to Cyrell describes an adjustable framing system for securing an object such as a television set. The framing system is comprised of four rigid corner pieces and slidably adjustable side members that join said corner pieces to produce a confining aperture of strictly rectangular configuration, having four right-angle corners.

U.S. Pat. No. 6,810,598 to Boys discloses a template system for guiding drywall cutouts. Like the Cyrell patent, the template is comprised of four rigid corner pieces and slidably adjustable side members that join said corner pieces to produce an aperture of strictly rectangular configuration.

U.S. Pat. No. 5,076,162 to Goin describes an expandable frame for stretching and holding a fabric. The frame consists of four frame rails held together by four corner pieces in a manner to produce a frame of adjustable rectangular size.

U.S. Pat. No. 4,195,681 to Douglas, et. al., concerns a frame of adjustable rectangular perimeter for securing a fly screen for windows and doors having an accommodating rectangular opening.

U.S. Pat. Nos. 3,910,327; 3,985,168 and Re34,374 disclose adjustable work-holding frames and a template for framing and cutting sheet materials. Each is restricted to strictly rectangular configurations and further involves portions that protrude outwardly at each corner. Such protrusions prevent use in applications wherein the frame must be inserted into a close fitting rectangular aperture.

The aforesaid framing and template devices lack the capability of conforming to shapes which, although four-sided, are not perfectly rectangular, such as trapezoidal shapes and substantially rectangular shapes having imperfections or irregularities in their angles and/or side lengths, or are otherwise asymmetric. Neither can many of the prior framing devices be inserted into an aperture to achieve measurement and replication of said aperture. A further shortcoming of the aforesaid measuring and framing devices is that they cannot be deployed upon a structure that is not accessible from either of the extremities, said extremities having features larger than the intervening structure sought to be replicated.

It is accordingly an object of the present invention to provide a hand-manipulated apparatus for replicating the perimeter of a quadrilaterally shaped object or aperture.

It is a further object of this invention to provide apparatus as in the foregoing object having a four sided frame structure capable of adjustably conforming to quadrilateral shapes.

It is another object of the present invention to provide apparatus of the foregoing nature capable of embracingly wrapping around quadrilaterally shaped objects.

It is yet another object of this invention to provide a kit of components for fabricating said apparatus in various sizes to accommodate quadrilateral shapes of widely varied sizes.

It is a still further object of the present invention to provide an apparatus of the aforesaid nature of durable construction and amenable to low cost manufacture.

These objects and other objects and advantages of the invention will be apparent from the following description.

SUMMARY OF THE INVENTION

The above and other beneficial objects and advantages are accomplished in accordance with the present invention by an apparatus comprised of four sides of slidably adjustable length having extremities that pivotably engage the extremities of contiguous sides to form a substantially coplanar frame of adjustable quadrilateral shape, said sides being comprised of two elongated rigid, substantially flat arms disposed one atop another, extending between innermost and outermost extremities and having aligned longitudinally centered slots and tracking means permitting sliding movement in the direction of elongation but preventing movement in the transverse direction, and an aperture in each outermost extremity. Securing means extend through said slots to threadably lock said arms in a desired state of elongation, and threaded locking means extend through said apertures to secure said sides in a desired angular relationship.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
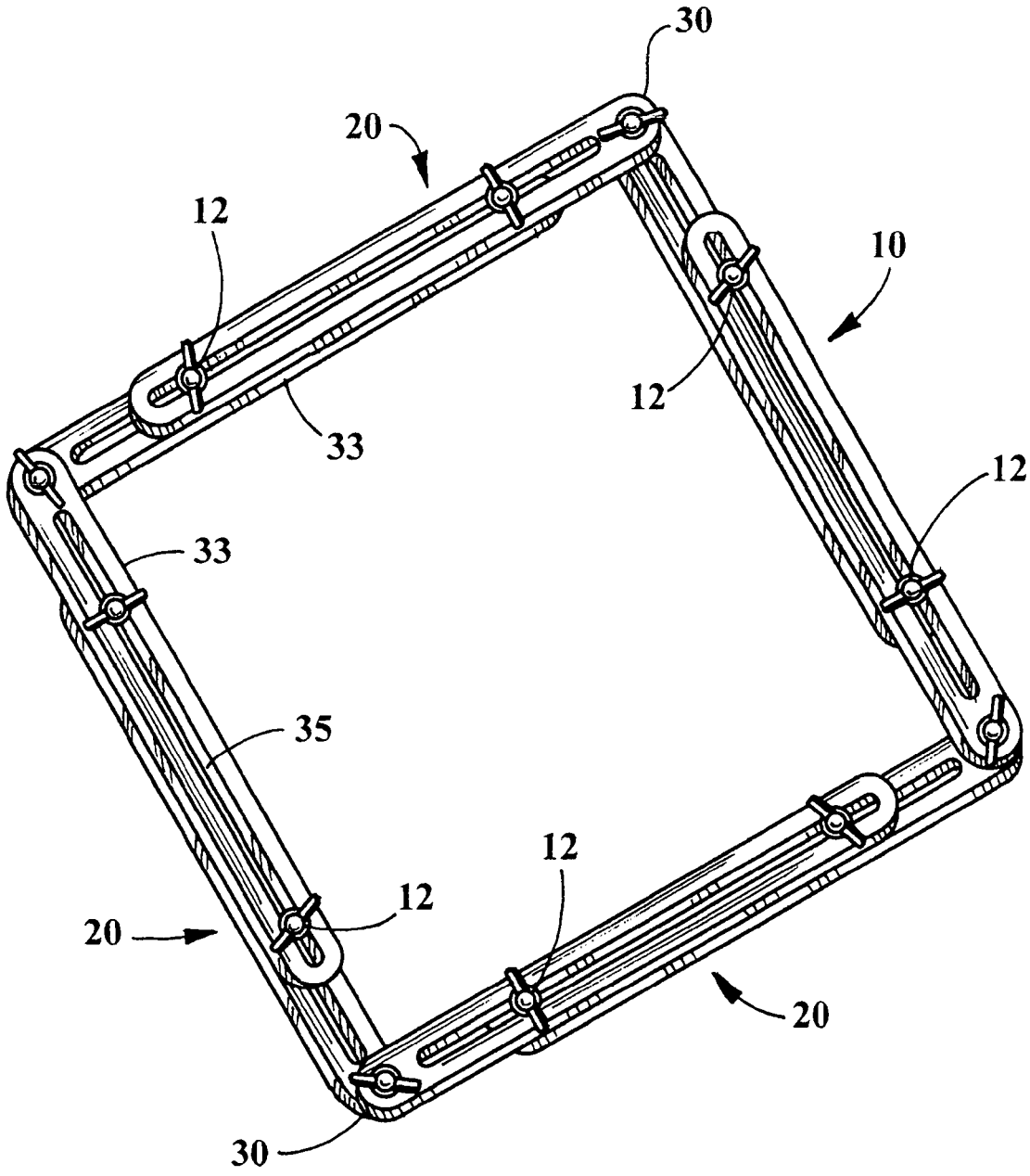
FIG. 1 is a top perspective view of an embodiment of the four-sided replicating apparatus of the present invention.
Figure 2:
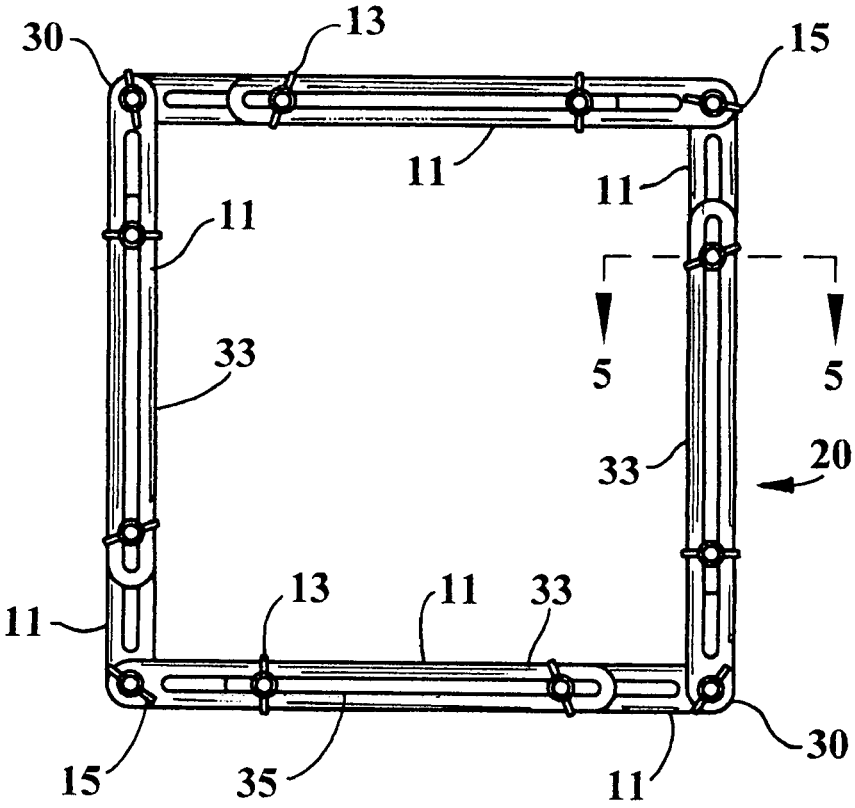
FIG. 2 is a top plan view of the embodiment of FIG. 1.

Referring now to FIGS. 1-5, an embodiment of the replicating apparatus 10 of the present invention is shown comprised of eight rigid elongated arms 11, eight carriage bolts 12 with associated wing nuts 13, and four circular threaded bolts 14 with associated wing nuts 15.

Arms 11 are of substantially flat construction, having been fabricated from flat sheet stock material having a uniform thickness in the range of ⅛ to ¼ inch. Suitable materials include aluminum and rigid plastics. The arms are bounded in part by straight parallel edges 16. The planar width of the arms, measured orthogonally between edges 16, may range from about 1 to 2 inches. Said arms extend between a proximal end 17 having a circular aperture 28, and an opposite, distal end 18. Each end is rounded within the plane of the arm.

An elongated slot 35 is centrally disposed in each arm, and extends to within about 2 inches of each end of the arm.

To form the replicating apparatus of this invention, the eight arms are arranged to form an array having four sides 20 wherein each side is constituted of two arms, one atop the other in coextensive alignment. One of said arms may be designated upper arm 21, and the second arm may be designated lower arm 22. Each pair of upper and lower arms is then interconnected by two carriage bolts 12 and associated wing nuts 13. Said interconnection is such that the proximal ends of the arms of each side are oppositely directed. The carriage bolts, having a square base 23, circular retaining head 25, and threaded upper shank 26 pass upwardly through aligned slots 35. Said square base permits controlled sliding adjustment of the interconnected arms while preventing rotative movement away from the direction of elongation of the arms. The use of paired carriage bolts in spaced apart relationship on each side of the apparatus represents tracking means which restrict the arms to longitudinal movement. Said paired bolts also serve as securing means for locking the overall length of each side. Wing nuts 13 disposed atop upper arms 21 in threaded engagement with bolts 12 are employed to lock the positions of longitudinal interaction of the upper and lower arms.

Figure 3:
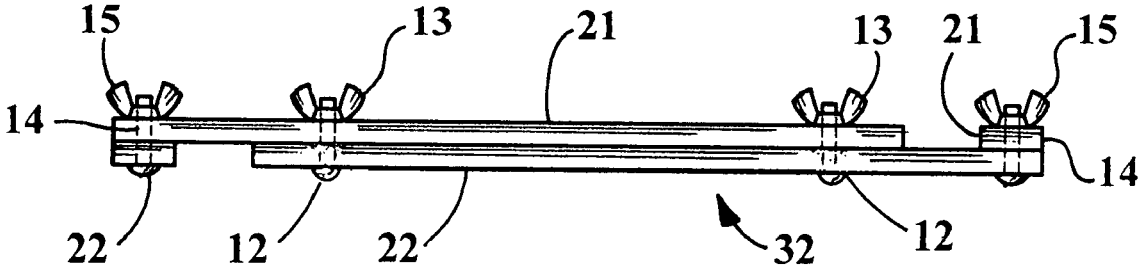
FIG. 3 is an enlarged side view, all four sides being of substantially identical appearance.
Figure 4:
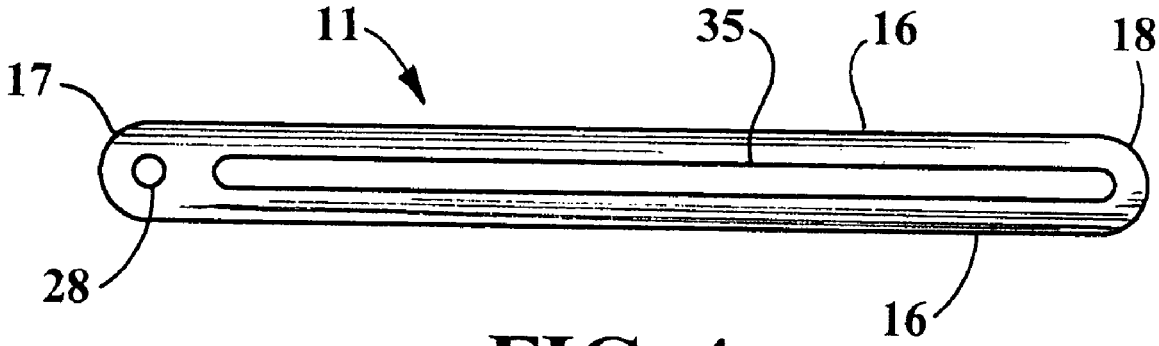
FIG. 4 is a top plan view of an arm component of the apparatus of FIG. 1.
Figure 5:
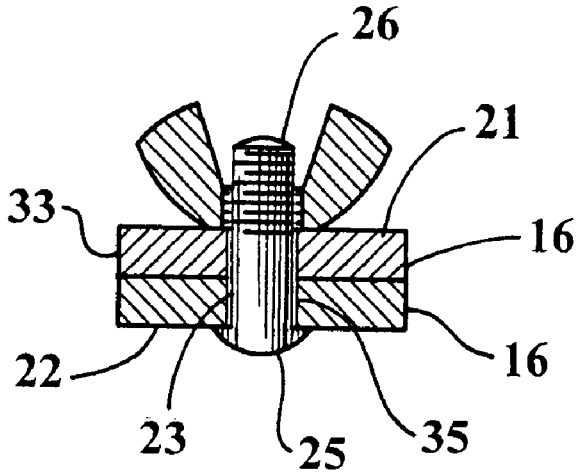
FIG. 5 is an enlarged sectional view taken in the direction of the arrows upon the line 5-5 of FIG. 2.

The separate sides 20 are arranged in a substantially rectangular array in a manner such that the distal ends 18 of said arms are directed in the same circuitous sequence, whether clockwise or counterclockwise. The apertures 28 of the proximal ends of successive upper and lower arms are brought into alignment and secured with penetrating circular threaded bolt 14 and associated nut 15. Such manner of interengagement of the proximal ends of the arms forms a corner 30 which permits pivotal movement of contiguous sides of the array. In forming the apparatus from its component parts it is desirable to have the proximal end of lower arm 22 positioned below the proximal end of the next successive upper arm 21 at each corner. Such arrangement, as best shown in FIG. 3, causes the apparatus to have a uniform thickness of two layers of arms, and having a substantially coplanar bottom surface 32 which will lie flat against a flat surface.

In employing the apparatus to replicate, for example, the rectangular contour of a wall-mountable air conditioner, all wing nuts are loosened, and the apparatus is placed upon the portion of the air conditioner that must penetrate the wall. The four sides 20 are then pushed into close conformity with the air-conditioner, and all wing nuts are tightened. The apparatus is then removed and held against the wall. Employing interior edges 33 of the apparatus as a guide, a marking pencil is used to trace the exact outline of the air conditioner onto the wall. Such outline facilitates the cutting of an exact aperture in the wall to receive the air conditioner. In instances where the apparatus cannot be mounted upon the object to be replicated, one of the corner bolts can be removed, thereby enabling the apparatus to pivot about the diagonally opposite corner bolt and be effectively wrapped around the object, then removed and re-bolted.

The lengths of the arms may vary from about 20 inches to 9 feet, and the apparatus may be sold in the form of a kit having a number of arms of various lengths, along with the necessary bolts and wing nuts. Such kits have the versatility of being selectively effective in measuring or replicating quadrilateral structures having sides ranging from about 20 inches to 9 feet.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Apparatus for replicating quadrilateral shapes, said apparatus having components comprising:

a) four sides of slidably adjustable length having extremities that pivotably engage the extremities of contiguous sides to form a substantially coplanar frame of adjustable quadrilateral shape, said sides being comprised of two elongated rigid, substantially flat arms disposed one atop another, extending between distal and rounded proximal ends and having aligned longitudinally centered slots, and tracking means comprised of two bolts in spaced apart relationship which penetrate said aligned slots to permit sliding separation in the direction of elongation but prevent movement in the transverse direction, and a circular aperture in each proximal end, b) securing means threadably interactive with said bolts to adjustably hold said arms in a desired state of separation, and c) threaded locking means extending through said apertures to interconnect and secure said sides in a desired angular relationship.

2. The apparatus of claim 1 wherein said securing means are wing nuts.

3. The apparatus of claim 1 wherein said bolts are carriage bolts having a square base that interacts with said slots.

4. The apparatus of claim 3 in the form of a kit whose components are comprised of at least eight arms, eight carriage bolts, and four threaded locking means.

5. The apparatus of claim 1 wherein the arms of each side may be further designated as upper and lower arms, and the interconnection of said sides by said locking means is such that the proximal ends of the arms of each side are oppositely directed.

6. The apparatus of claim 5 wherein said securing means are positioned atop said upper arms.

7. The apparatus of claim 5 wherein the distal ends of said arms are directed in the same circuitous sequence, whether clockwise or counterclockwise.

8. The kit of claim 4 having arms of varied size to permit the construction of variously sized apparatus.

* * * * *